US010480169B2

(12) United States Patent
Schneider

(10) Patent No.: US 10,480,169 B2
(45) Date of Patent: Nov. 19, 2019

(54) DEVICE AND METHOD FOR TOILET ODOR SHIELDING

(71) Applicant: Evan Schneider, Piedmont, CA (US)

(72) Inventor: Evan Schneider, Piedmont, CA (US)

( * ) Notice: Subject to any disclaimer, the term of this patent is extended or adjusted under 35 U.S.C. 154(b) by 69 days.

(21) Appl. No.: 15/899,212

(22) Filed: Feb. 19, 2018

(65) Prior Publication Data

US 2018/0238036 A1 Aug. 23, 2018

Related U.S. Application Data

(60) Provisional application No. 62/460,956, filed on Feb. 20, 2017.

(51) Int. Cl.

| | |
|---|---|
| ***E03D 9/03*** | (2006.01) |
| ***E03D 9/00*** | (2006.01) |
| ***E03D 9/02*** | (2006.01) |

(52) U.S. Cl.
CPC ..... *E03D 9/037* (2013.01); *E03D 9/005* (2013.01); *E03D 2009/028* (2013.01)

(58) Field of Classification Search
CPC .... E03D 9/037; E03D 9/005; E03D 2009/028
USPC ..... 4/224, 227.2, 225.1
See application file for complete search history.

(56) References Cited

U.S. PATENT DOCUMENTS

| | | | | |
|---|---|---|---|---|
| 5,307,525 | A | 5/1994 | O'Brien | |
| 8,484,769 | B1 * | 7/2013 | Berry | E03D 9/037 4/225.1 |
| 2004/0064884 | A1 | 4/2004 | Egeresi | |
| 2004/0216221 | A1 | 11/2004 | Chen | |
| 2007/0113327 | A1 | 5/2007 | Denkewicz et al. | |
| 2011/0259973 | A1 | 10/2011 | Pedicano et al. | |

* cited by examiner

*Primary Examiner* — Tuan N Nguyen
(74) *Attorney, Agent, or Firm* — AKC Patents, LLC; Aliki K. Collins

(57) ABSTRACT

An electronic toilet odor shielding device includes a main body and a container. The main body includes a sensing device and a pump. The container includes an odor shielding compound. The electronic toilet odor shielding device is placed and attached within a toilet water tank of a toilet. The sensing device is configured to sense a toilet water tank flush event and to trigger the pump to draw the odor shielding compound from the container and subsequently to dispense the odor shielding compound into a toilet bowl of the toilet. The odor shielding compound that is dispensed into the toilet bowl forms an odor shielding film on top of a water surface within the toilet bowl.

19 Claims, 11 Drawing Sheets

DEVICE AND METHOD FOR TOILET ODOR SHIELDING

CROSS REFERENCE TO RELATED CO-PENDING APPLICATIONS

This Application Claims the Benefit of U.S. Provisional Application Ser. No. 62/460,956 Filed on Feb. 20, 2017 and Entitled DEVICE AND METHOD FOR TOILET ODOR SHIELDING, which is commonly assigned and the contents of which are expressly incorporated herein by reference.

FIELD OF THE INVENTION

The present invention relates to a device and a method for toilet odor shielding and in particular to a toilet odor shielding device that includes an integrated power source and a sensor for automatically dispensing an odor shielding compound.

BACKGROUND OF THE INVENTION

Toilet associated odors are usually handled via air ventilation systems or odor covering fragrances. The air ventilations systems may be designed to remove odors from the entire room where the toilet is located or may be designed to remove odorous air directly from the toilet. In either case, the air ventilation systems require major infrastructure installations of fans and exhaust pipes. Odor covering fragrances include air fresheners and odor neutralizing sprays and are usually dispensed in the room where the toilet is located. Air fresheners try to cover the toilet odors whereas the odor neutralizing sprays try to neutralize the toilet odors. In either case, the odor covering fragrances are not usually very effective in removing odors. Air purifiers have also been used in handling toilet associated odors. However, the effective air purifiers are usually expensive and they take some time to remove unpleasant odors. Accordingly, there is a need for a device for removing toilet associated odors that is small, effective, does not require major infrastructure remodeling and is inexpensive.

SUMMARY OF THE INVENTION

The invention features a device and a method for toilet odor shielding. The toilet odor shielding device includes an integrated power source and a sensor for automatically dispensing an odor shielding compound.

In general, in one aspect, the invention features an electronic toilet odor shielding device including a main body and a container. The main body includes a sensing device and a pump. The container includes an odor shielding compound. The electronic toilet odor shielding device is configured to be placed and attached within a toilet water tank of a toilet. The sensing device is configured to sense a toilet water tank flush event and to trigger the pump to draw the odor shielding compound from the container and subsequently to dispense the odor shielding compound into a toilet bowl of the toilet.

Implementations of this aspect of the invention include one or more of the following. The main body is seamless and waterproof and the container is attached to a side slot of the main body and the side slot is sealed by the container. The device further includes a first tube and a second tube and the pump draws the odor shielding compound from the container via the first tube and subsequently dispenses the odor shielding compound into a toilet bowl of the toilet via the second tube. An open end of the second tune is placed within an overfill tube of the toilet water tank. The main body further includes a power source that provides power to the pump. The power source is a battery pack. The sensing device comprises one or more pins that change electrical conductivity based on a medium they are embedded in. The one or more pins are metal pins that protrude from a side of the main body. The main body further comprises a programmable printed circuit board (PCB) and the programmable PCB controls the ON/OFF operation of the pump based on signals received from the sensing device. The programmable PCB is configured to program a start time of the toilet water tank flush event and a volume of a dose of the odor shielding compound that is to be dispensed within the toilet bowl with each toilet water tank flush event. The programmable PCB performs periodic checks of the sensing device. The odor shield device may further include an additional container comprising a cleaning solution, and the PCB is programmed to periodically trigger the pump to draw the cleaning solution from the additional container and subsequently to dispense the cleaning solution into the toilet bowl. The odor shielding compound may be one of odor shielding oils, emulsifiers, thinners, scents, bubble forming liquids, and coloring agents. The odor shielding compound that is dispensed into the toilet bowl forms an odor shielding film on top of a water surface within the toilet bowl. The odor shielding compound forms an emulsion with toilet bowl water that encapsulates solid waste. The main body is attached to an inner side of the toilet water tank so that the sensing device is submerged in water contained in the toilet water tank and the sensing device emerges out of the water contained in the toilet water tank and becomes dry when the toilet is flushed and the water contained in the toilet water tank empties into the toilet bowl. The main body is attached to the inner side of the toilet water tank via one of mechanical connection, magnetic connection, adhesive connection, a hook or a hook and loop type of connection. The electronic odor shielding device is programmed to wait three seconds between sensing of the toilet water tank flush event and dispensing of the odor shielding compound into the toilet bowl. The main body is attached to an outer side of the toilet water tank.

In general, in one aspect, the invention features a toilet odor shielding method that includes the following. First, providing an electronic toilet odor shielding device comprising a main body and a container. The main body comprises a sensing device and a pump and the container comprises an odor shielding compound. Next, placing and attaching the electronic toilet odor shielding device within a toilet water tank of a toilet. Next, sensing a toilet water tank flush event via the sensing device and triggering the pump to draw the odor shielding compound from the container and subsequently dispensing the odor shielding compound into a toilet bowl of the toilet. The odor shielding compound that is dispensed into the toilet bowl forms an odor shielding film on top of a water surface within the toilet bowl.

The details of one or more embodiments of the invention are set forth in the accompanying drawings and description below. Other features, objects, and advantages of the invention will be apparent from the following description of the preferred embodiments, the drawings and from the claims.

DETAILED DESCRIPTION OF THE INVENTION

The present invention provides a device and a method for toilet odor shielding. The toilet odor shielding device includes an integrated power source and a sensor for automatically dispensing an odor shielding compound.

Figure 1:
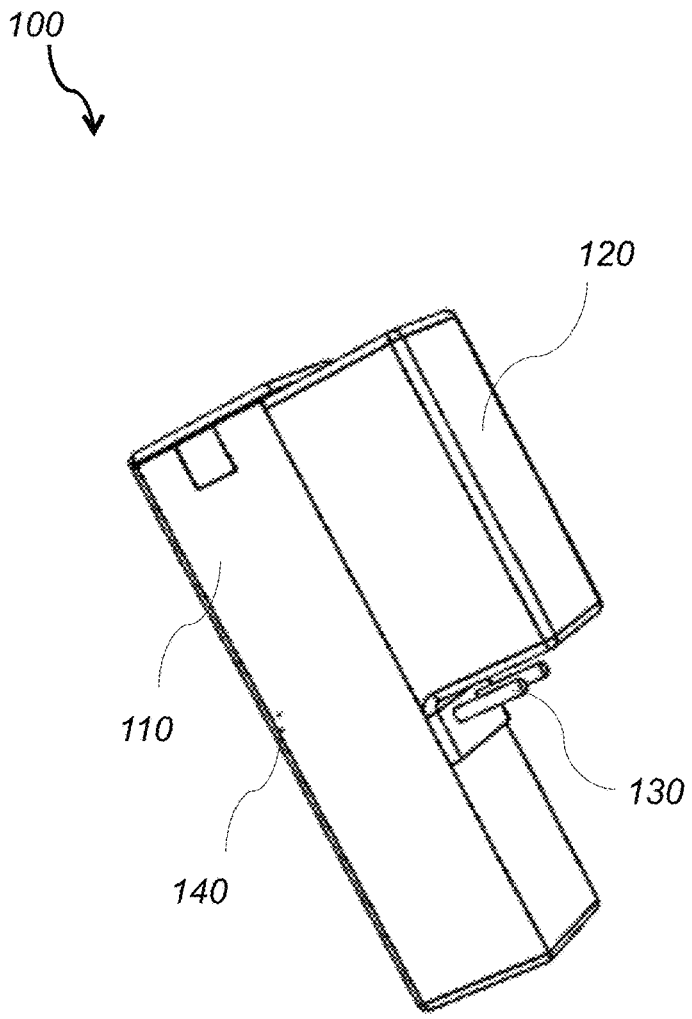
FIG. 1 is a perspective view of a toilet odor shielding device according to this invention.
Figure 2:
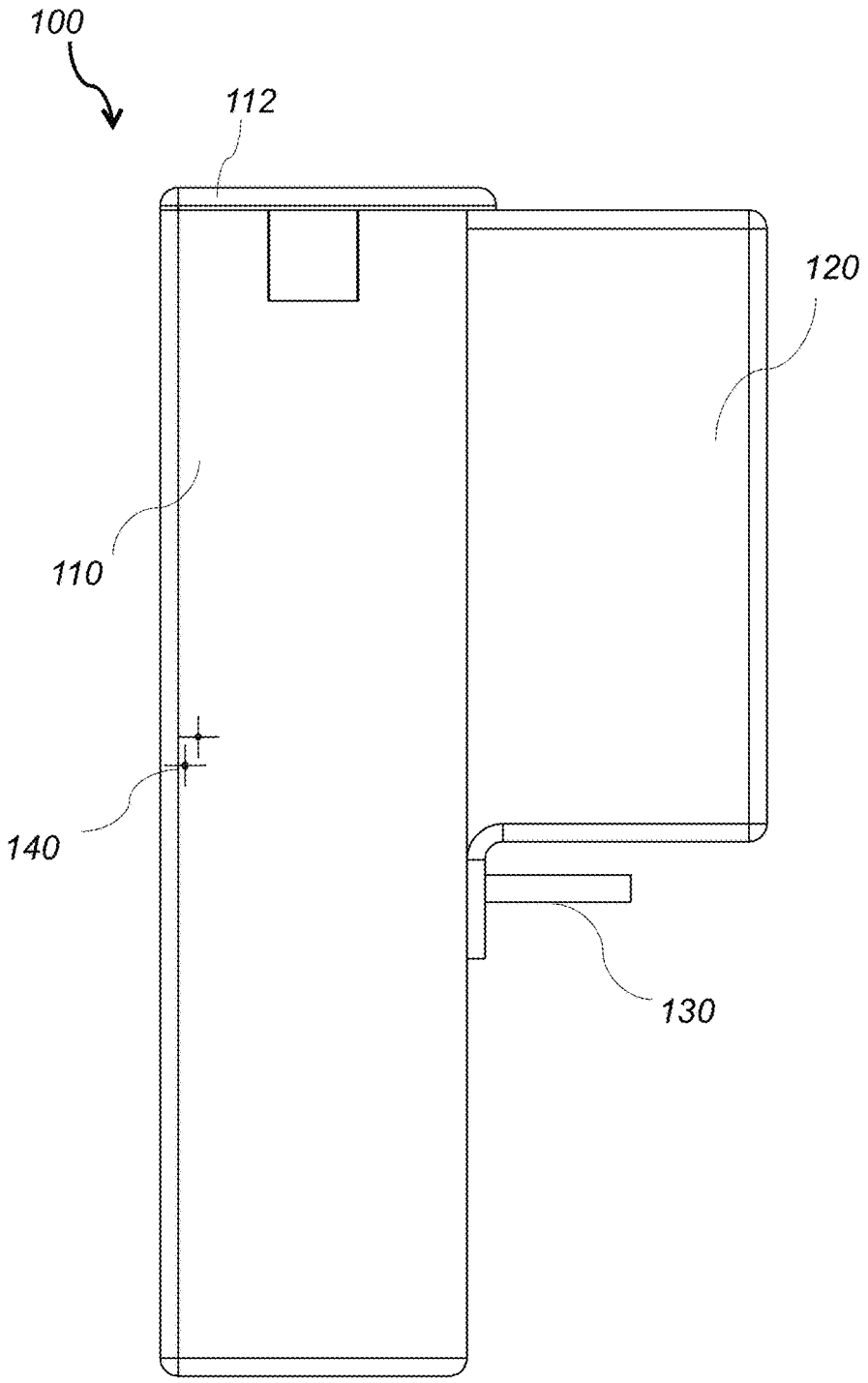
FIG. 2 is a side view of the toilet odor shielding device of FIG. 2.
Figure 3:
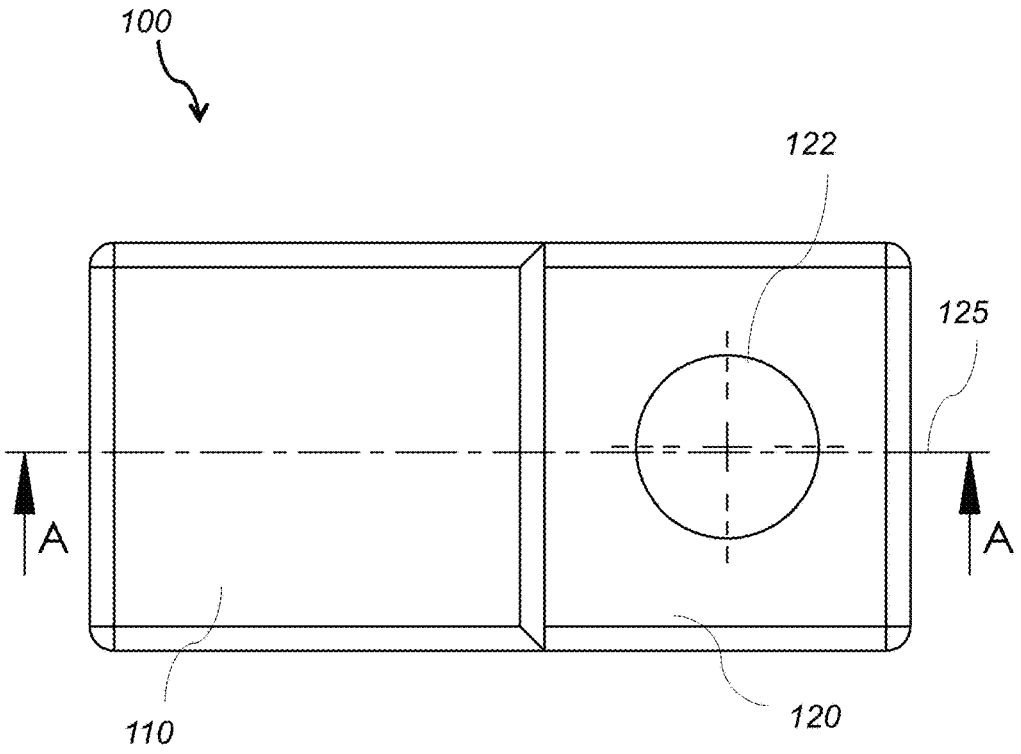
FIG. 3 is a top view of the toilet odor shielding device of FIG. 2.
Figure 4:
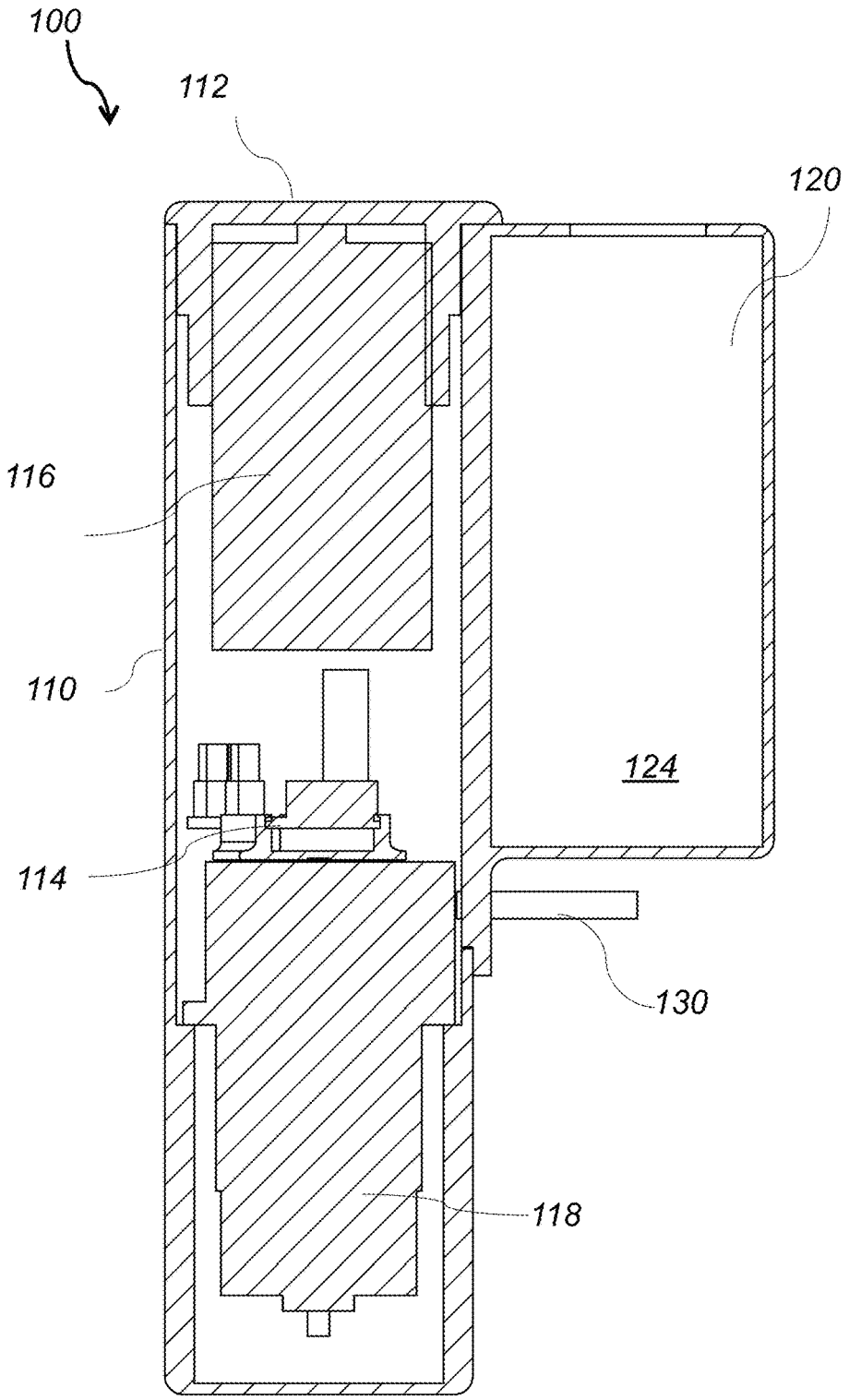
FIG. 4 is a cross-sectional view of the toilet odor shielding device of FIG. 2.
Figure 5:
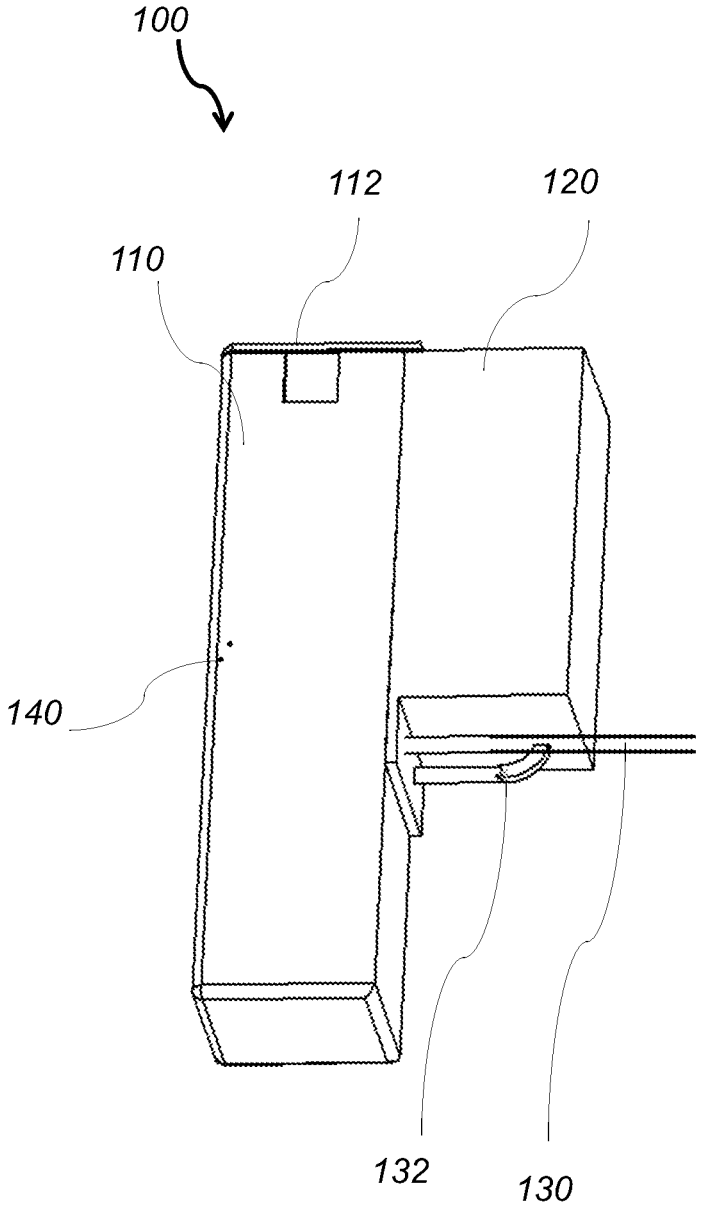
FIG. 5 is a side view of a prototype of the toilet odor shielding device of this invention.
Figure 6:
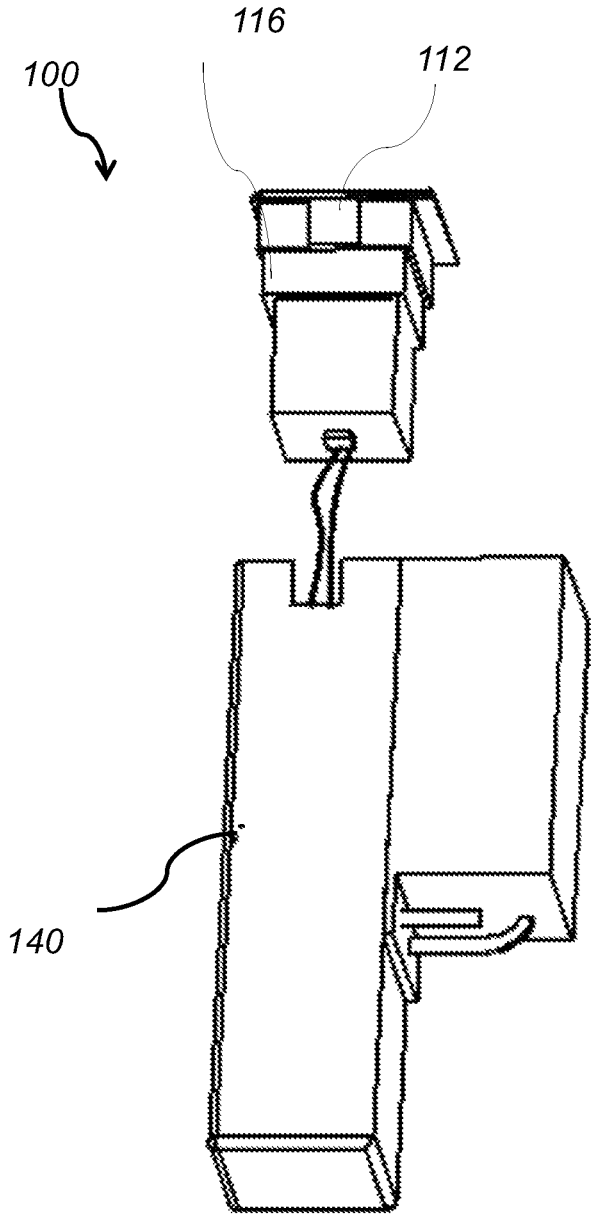
FIG. 6 is a partially exploded side view of the toilet odor shielding device of FIG. 5.
Figure 7:
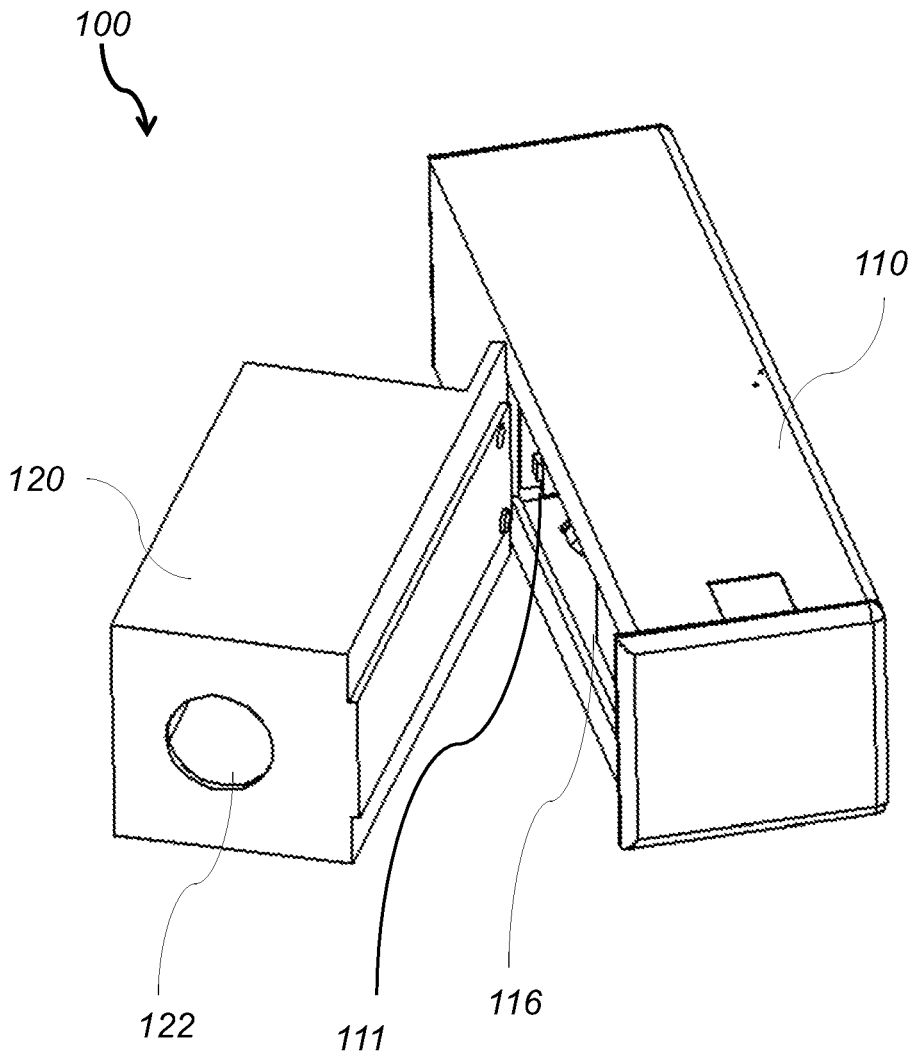
FIG. 7 is another partially exploded side view of the toilet odor shielding device of FIG. 5.
Figure 8:
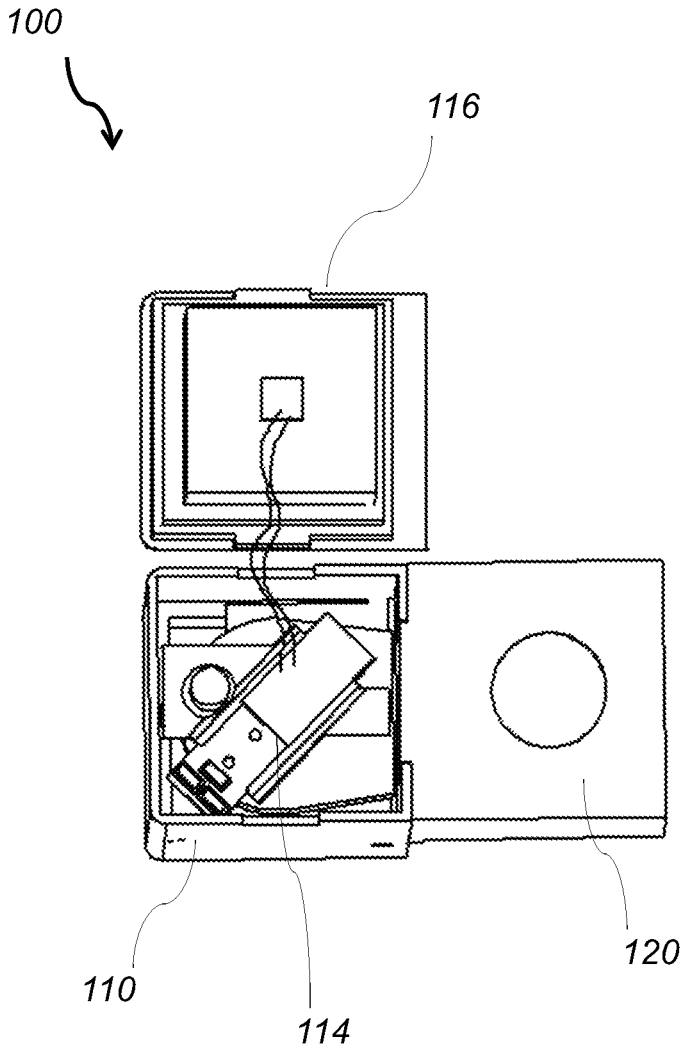
FIG. 8 is a partially exploded top view of the toilet odor shielding device of FIG. 5.
Figure 9:
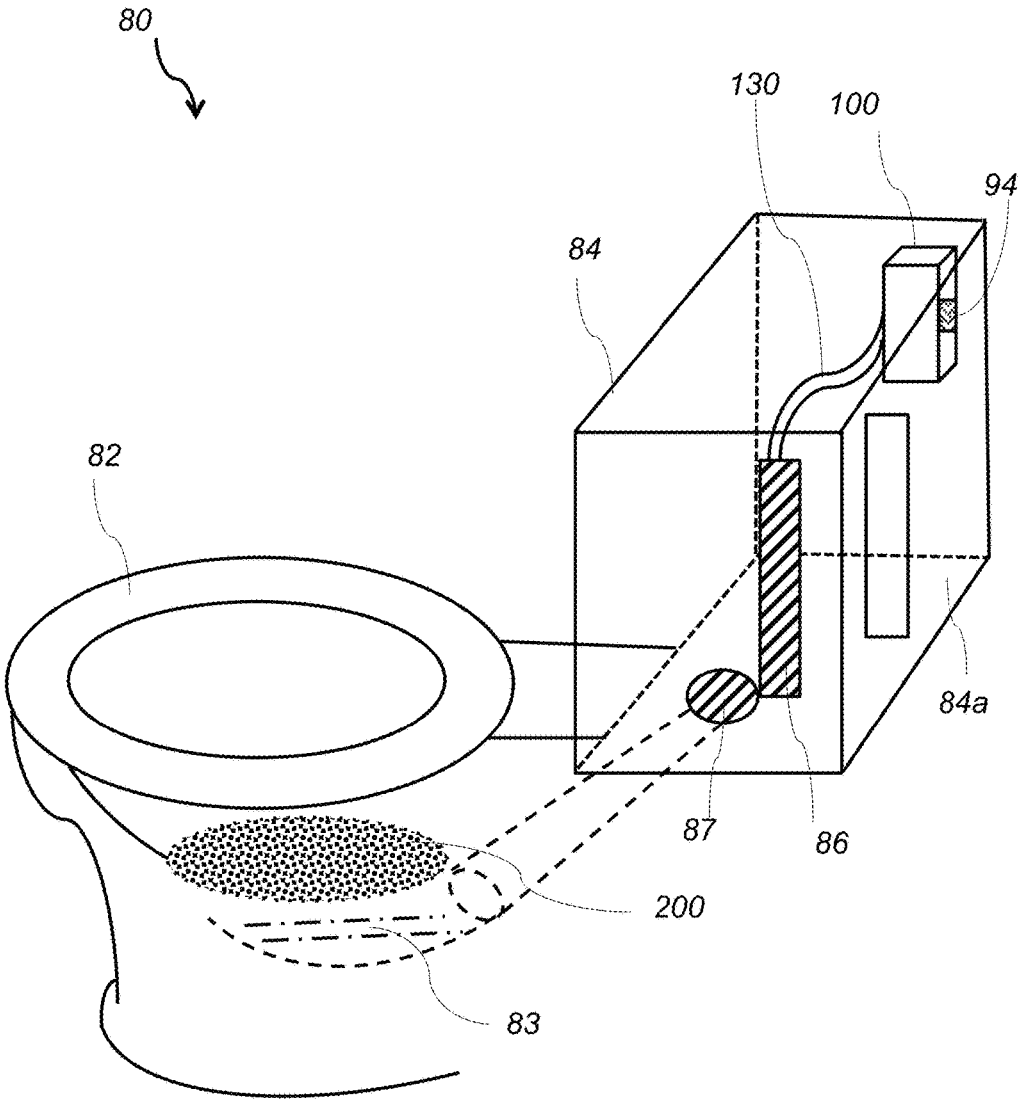
FIG. 9 depicts the toilet odor shielding device of this invention positioned in the water tank of a toilet.

Referring to FIG. 1 to FIG. 8, a toilet odor shielding device 100 includes a main body 110, a tank 120, and tubes 130. The main body 110 is a seamless waterproof container and the tank 120 is attached to a side slot 111 of the main body 110, as shown in FIG. 7. Side slot 11 is sealed by the tank 120 or by another piece of flanged plastic. Main body 110 contains a battery pack 116, a programmable printed circuit board (PCB) 114, sensing pins 140, and a peristaltic pump 118. Tank 120 contains the odor shielding liquid 124. Battery pack 116 provides power to the peristaltic pump 118 and PCB 114 controls the ON/OFF operation of the pump 118 based on signals received from the sensing pins 140. Battery pack 116 includes 4 AA batteries and is designed to provide power for several years or about 7250 "flush events". The programmable PCB 114 allows for customization of the "flush event" start time and of the volume of a dose of the odor shielding liquid 124 that is to be dispensed with each flush. Sensing pins 140 protrude from the side of the main body 110, as shown in FIG. 2, and are usually metal pins that change conductivity based on the medium they are embedded in. Pump 112 draws a dose of the odor shielding liquid 124 from the tank 120 via tube 132 and dispenses the odor shielding liquid 124 into the toilet bowl 82 via tube 130. The open end of tube 130 is placed inside the overfill tube of the toilet water tank 84, as shown in FIG. 9. The odor shielding liquid 124 forms an odor shielding film 200 on the top surface of the water 83 in the toilet bowl 82 and the odor shielding film 200 traps the odor causing particles in the toilet bowl and prevents the odor from escaping in the atmosphere. The odor shielding liquid 124 includes odor shielding oils, emulsifiers, thinners, scents, and coloring agents. In one example, odor shielding liquid 124 includes 50 g oleic acid (scent blocking film), 20 g polysorbate 20 (emulsifier), 75 g alcohol (emulsifier/thinner), 25 g essential oils (scent) and about 10-20 drops coloring.

Figure 10:
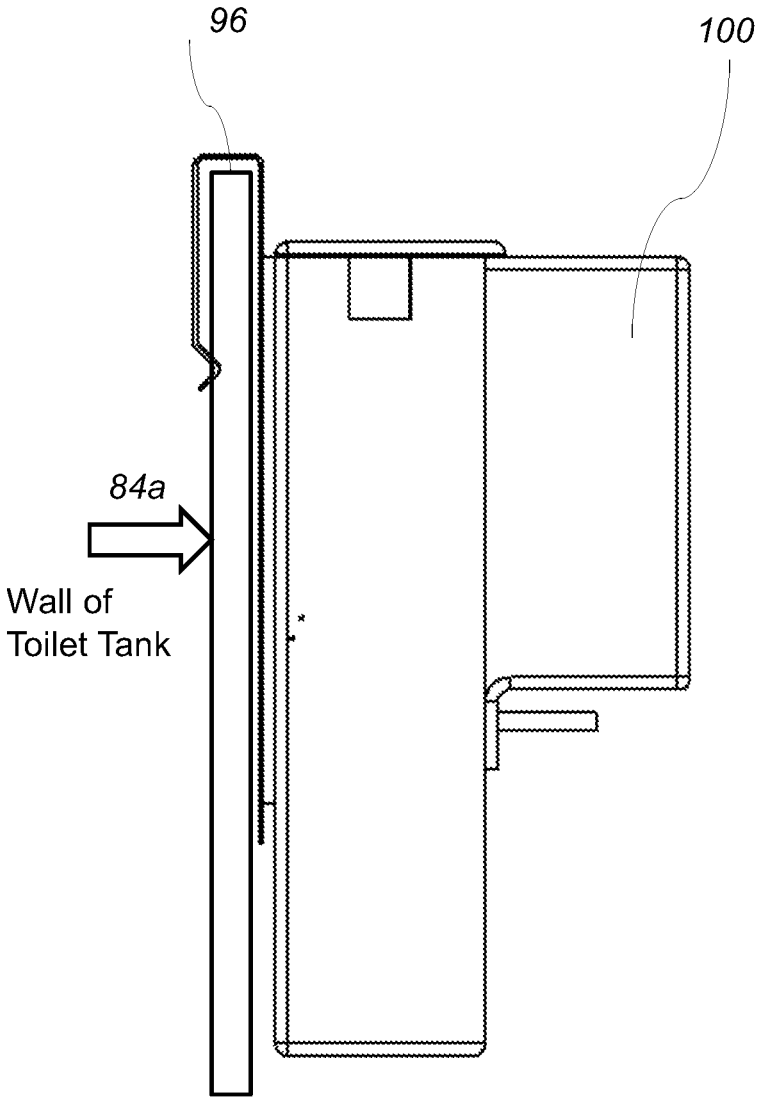
FIG. 10 is a side view of the toilet odor shielding device of FIG. 9.

Referring to FIG. 9, a device for toilet odor shielding 100 is attached to the back wall 84*a* of a water tank 84 that provides water to the toilet 82. The odor shielding device 100 is attached to the back wall 84*a* via a Velcro hook and loop type attachment 94. In other embodiments, device 100 is attached to the back wall via a hook 96, as shown in FIG. 10, other mechanical connections, a magnetic connection or via a removable adhesive, among others. Device 100 includes a tube 130 that feeds a dose of an odor shielding liquid 124 into the water tank overfill tube 86. The odor shielding liquid 124 mixes with the bowl fill water and forms an odor shielding film 200 on the top surface of water 83 that collects in the toilet bowl 82 after flushing of the toilet.

In operation, odor shielding device 100 is position within the water tank 84 so that the sensing pins 140 are usually submerged in the water and become momentarily "dry" (i.e., out of the water) when the toilet is flushed and the water in the tank 84 empties in the toilet bowl 82. During the flushing time period the programmable PCB 114 recognizes a "flush event" by receiving a signal from the sensing pins 140 which change conductivity when the become "dry". Upon receiving the "flush event" signal from the sensing pins 140, PCB 114 initiates the following programmable and modifiable series of events. First a delay of about 3 seconds takes place to allow for the flushing event to finish. Next, power is supplied to the miniature peristaltic pump 118 from the batter pack 116 and the pump 118 draws a dose of the odor shielding liquid 124 from the tank 120 and dispenses the dose of the odor shielding liquid 124 into the overfill tube 86. The dispensed dose of the odor shielding liquid 124 mixes with the water in the tank 84 and when the water fills the toilet bowl 82 it forms an odor shielding film 200 on the top surface of water 83 that collects in the toilet bowl 82. Next, the PCB 114 "waits" until the sensing pins 140 are once again submerged in the water of the tank 84, upon which the sensing pins 140 send a signal to the PCB 114 that the "flush event" is ended. At this point the PCB 114 is "armed" again and waits for the next "flush event". The PCB 114 checks the conductivity of the sensing pins 140 periodically (usually every several seconds) and goes to a low power "sleep mode" in between the conductivity checks in order to preserve the battery power. The volume of the dose of the odor shielding liquid is that is dispensed in the water tank with each "flush event" is customizable via the PCB. Similarly, the initial start time and delay time of the "flush event" are also customizable via the PCB.

Figure 11:
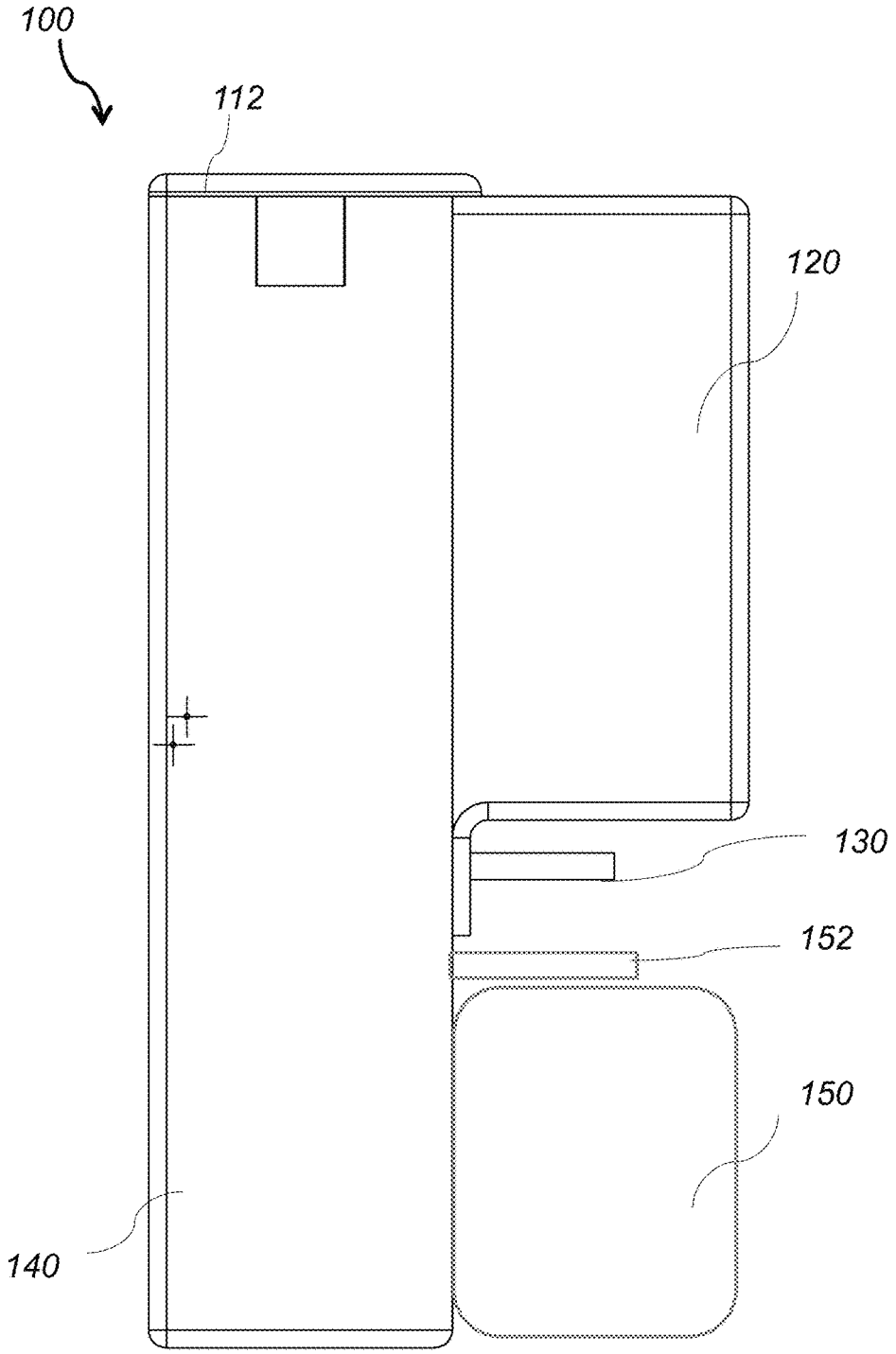
FIG. 11 is a side view of another embodiment of a toilet odor shielding device according to this invention.

Other embodiments include one or more of the following. The odor shielding device 100 is mounted on the outside of the water tank 84. The dose of odor shielding liquid is dispensed into the water tank feed line or the toilet bowl directly. The odor shielding liquid may be a bubble forming liquid. The scent tank's shape or location is altered such that it fits better into certain type(s) of toilets. The odor shielding liquid may form an emulsion with bowl water that encapsulates solid waste. The scent tank 120 may be removably attached to the main body 110. Referring to FIG. 11, in another embodiment the toilet odor shielding device 100 includes a main body 110, a first tank 120, tubes 130, a second tank 150, and tubes 152. Second tank 150 includes a cleaning solution. The single peristaltic pump 118 has two lines 130, 152, going into and out of it. When running in "forward" mode, the pump 118 draws odor shielding liquid 124 out of the first tank 120 and dispenses the odor shielding liquid 124 into the toilet via line 130, and simultaneously, pushes air (assuming that line 152 output is above water) into the second tank 150. When running in "reverse" mode, pump 118 draws cleaning solution out of the second tank 150 via line 152 and dispenses the cleaning solution into the toilet, and simultaneously pushes air into the first tank 120. The PCB is programmed to periodically trigger the pump to draw the cleaning solution from the additional container and subsequently to dispense the cleaning solution into the toilet bowl.

Among the advantages of this invention may be one or more of the following. The odor shielding device 100 provides an electronic detection mechanism for the toilet flushing event and dispenses an odor shielding liquid directly into the overfill tube of the toilet. The programmable PCB allows for customization of the "flush event" start time and of the volume of the dose that is to be dispensed with each flush. The odor shielding device 100 is contained within the water tank 84 and is not visible from the outside of the tank. The odor shielding device 100 is designed to be installed within the water tank 84 without the use of any special tools. The main body 110 of the odor shielding device 100 is waterproof and has no seams. Tank 120 is attached to the main body 110 and is designed to seal the side slot 111 of the main body 110. Tank 120 and main body 110 are easily assembled together to form the waterproof odor shielding device 100.

Several embodiments of the present invention have been described. Nevertheless, it will be understood that various modifications may be made without departing from the spirit

What is claimed is:

1. An electronic toilet odor shielding device comprising:

a main body comprising a sensing device, a controller, and a pump;

a container comprising an odor shielding compound;

wherein the electronic toilet odor shielding device is configured to be placed and attached to a toilet water tank of a toilet;

wherein the sensing device is configured to sense a toilet water tank flush event and communicate the toilet water tank flush event to the controller;

wherein the controller is programmed to trigger the pump to draw the odor shielding compound from the container upon receipt of the toilet water tank flush event and subsequently to dispense the odor shielding compound into a toilet bowl of the toilet, after a delay time;

wherein the sensing device comprises one or more pins that change electrical conductivity based on a medium they are embedded in.

2. The device of claim 1, wherein the main body is seamless and waterproof, and the container is attached to a side slot of the main body and the side slot is sealed by the container.

3. The device of claim 1, further comprising a first tube and a second tube and wherein the pump draws the odor shielding compound from the container via the first tube and subsequently dispenses the odor shielding compound into a toilet bowl of the toilet via the second tube.

4. The device of claim 3, wherein an open end of the second tube is placed within an overfill tube of the toilet water tank.

5. The device of claim 1, wherein the main body further comprises a power source that provides power to the pump.

6. The device of claim 5, wherein the power source is a battery pack.

7. The device of claim 1, wherein the one or more pins are metal pins that protrude from a side of the main body.

8. The device of claim 1, wherein the controller comprises a programmable printed circuit board (PCB) and wherein the programmable PCB controls the ON/OFF operation of the pump based on signals received from the sensing device.

9. The device of claim 8, wherein the programmable PCB is configured to program a start time of the toilet water tank flush event and a volume of a dose of the odor shielding compound that is to be dispensed within the toilet bowl with each toilet water tank flush event.

10. The device of claim 8, wherein the controller performs periodic checks of the sensing device.

11. The device of claim 8, further comprising an additional container comprising a cleaning solution, and wherein the programmable PCB is programmed to periodically trigger the pump to draw the cleaning solution from the additional container and subsequently to dispense the cleaning solution into the toilet bowl.

12. The device of claim 1, wherein the odor shielding compound comprises one of odor shielding oils, emulsifiers, thinners, scents, bubble forming liquids, and coloring agents.

13. The device of claim 1, wherein the odor shielding compound that is dispensed into the toilet bowl forms an odor shielding film on top of a water surface within the toilet bowl.

14. The device of claim 1, wherein the odor shielding compound forms an emulsion with toilet bowl water that encapsulates solid waste.

15. The device of claim 1, wherein the main body is attached to an inner side of the toilet water tank so that the sensing device is submerged in water contained in the toilet water tank and wherein the sensing device emerges out of the water contained in the toilet water tank and becomes dry when the toilet is flushed and the water contained in the toilet water tank empties into the toilet bowl.

16. The device of claim 15, wherein the main body is attached to the inner side of the toilet water tank via one of mechanical connection, magnetic connection, adhesive connection, a hook or a hook and loop type of connection.

17. The device of claim 1, wherein the electronic odor shielding device is programmed to wait three seconds between sensing of the toilet water tank flush event and dispensing of the odor shielding compound into the toilet bowl.

18. The device of claim 1, wherein the main body is attached to an outer side of the toilet water tank.

19. A toilet odor shielding method comprising:

providing an electronic toilet odor shielding device comprising a main body and a container, wherein the main body comprises a sensing device a controller, and a pump and wherein the container comprises an odor shielding compound;

placing and attaching the electronic toilet odor shielding device to a toilet water tank of a toilet; and sensing a toilet water tank flush event via the sensing device and communicating the toilet water tank flush event to the controller;

wherein the controller is programmed to trigger the pump to draw the odor shielding compound from the container upon receipt of the toilet water tank flush event and subsequently to dispense the odor shielding compound into a toilet bowl of the toilet, after a delay time;

wherein the sensing device comprises one or more pins that change electrical conductivity based on a medium they are embedded in.

* * * * *